United States Patent [19]

Blikken

[11] 4,239,415

[45] Dec. 16, 1980

[54] METHOD OF INSTALLING MAGNETIC SENSOR LOOPS IN A MULTIPLE LANE HIGHWAY

[76] Inventor: Wendell A. Blikken, 952 S. Grove, Ypsilanti, Mich. 48197

[21] Appl. No.: 958,112

[22] Filed: Nov. 6, 1978

[51] Int. Cl.[3] ..... E01F 11/00

[52] U.S. Cl. ..... 404/75; 404/72; 404/71

[58] Field of Search ..... 404/72, 75, 1, 71; 340/38 L, 31 R

[56] References Cited

U.S. PATENT DOCUMENTS

| | | | |
|---|---|---|---|
| 3,641,569 | 2/1972 | Bushnell | 340/38 L |
| 3,651,452 | 3/1972 | Friedman | 340/38 L |
| 3,745,450 | 7/1973 | Wilt | 340/38 L |
| 3,863,206 | 1/1975 | Rabie | 340/38 L |
| 3,983,531 | 9/1976 | Corrigan | 340/38 L X |

*Primary Examiner*—Nile C. Byers, Jr.

*Attorney, Agent, or Firm*—Barnes, Kisselle, Raisch & Choate

[57] ABSTRACT

A method of installing an electromagnetic sensor loop in a multiple lane highway for monitoring vehicle traffic which includes the steps of placing a test loop at a desired location in a highway traffic lane approximately centrally thereof and varying the lateral dimension of the test loop until the field strength generated thereby at the lane edge is such that the loop will reliably distinguish between a vehicle in the lane in question and a vehicle in the next adjacent lane.

9 Claims, 8 Drawing Figures

METHOD OF INSTALLING MAGNETIC SENSOR LOOPS IN A MULTIPLE LANE HIGHWAY

The present invention is directed to highway traffic monitoring, and more particularly to the installation of sensor loops in a highway traffic lane electromagnetically to sense passage of a vehicle thereover as a variation in the effective inductance of the loop.

Sensor loops for detecting proximity of automotive vehicles are known in the art and have been used for a number of years in a variety of applications, such as at the entrances and exits of parking lots. Such loops generally operate on the principle that proximity of an automobile will vary the effective loop inductance, which variation may be sensed as a change in loop current when a constant or substantially constant voltage, particularly an a.c. voltage, is applied thereto. Sensor loops for parking lot applications are generally of factory selected contour and need not be particularly sensitive to the lateral position of a vehicle with respect to the loop. Where it has been attempted to utilize prefabricated sensor loops of this type in the monitoring of highway traffic, problems have arisen because the sensors are not lane selective. Stated differently, any one sensor may respond to vehicles in laterally adjacent highway lanes, such that one vehicle may be detected by a plurality of sensors and thus yield a false indication of highway traffic. On the other hand, a sensor may fail to respond to a vehicle (car or truck, etc.) at the lane edge. This problem apparently results in part from wide variations in concrete iron content and in the amount of steel reinforcement.

Accordingly, a general object of the present invention is to provide a method of installing sensor loops of the described type in a multiple lane highway in which each loop is responsive to vehicles in the associated traffic lane and is substantially unresponsive to vehicles in adjacent lanes. A further and more specific object of the invention is to provide a sensing loop for generating an electromagnetic field above a road surface of adequate height for vehicle detection and/or having a sharp cut-off at the lane edge to maximize the probability of sensing off center vehicles in the associated lane while minimizing the probability of sensing in the laterally adjacent lane.

Another object of the invention is to provide a method of installing traffic sensing loops in a preconstructed highway which can be accurately bid by a subcontractor.

A further object of the invention is to provide a test loop arrangement which includes facility for selectively adjusting the loop contour and thereby adjusting the magnetic field produced thereby.

The invention, together with additional objects, features and advantages thereof, will be best understood from the following description, the appended claims and the accompanying drawings in which:

Figure 1:
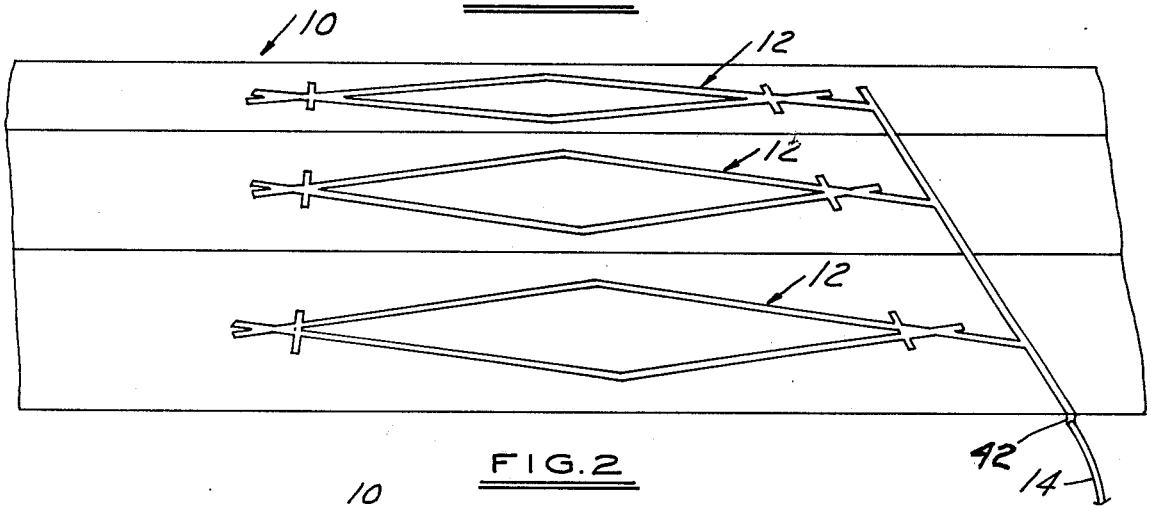
FIG. 1 is a perspective view of a three-lane highway in which sensor loops have been installed in accordance with the invention.

FIG. 1 illustrates a three-lane highway 10 in which inductive-type proximity detectors or sensor loops 12 have been installed in accordance with the invention to detect automotive vehicles or the like traveling in the associated highway lanes. The sensor loops 12 are individually connected by a multiple-conductor cable 14 to appropriate sensor detector electronics (not shown). Such electronics are well-known in the art and normally comprise a suitable circuit for applying a steady electrical voltage signal to each of the sensor loops, and for detecting a change in the corresponding magnetic field surrounding the sensor loop caused by the proximity of an automobile. Such automobile alters the inductance of the associated loop and is thereby sensed at the electronics as a corresponding change in loop current.

Figure 2:
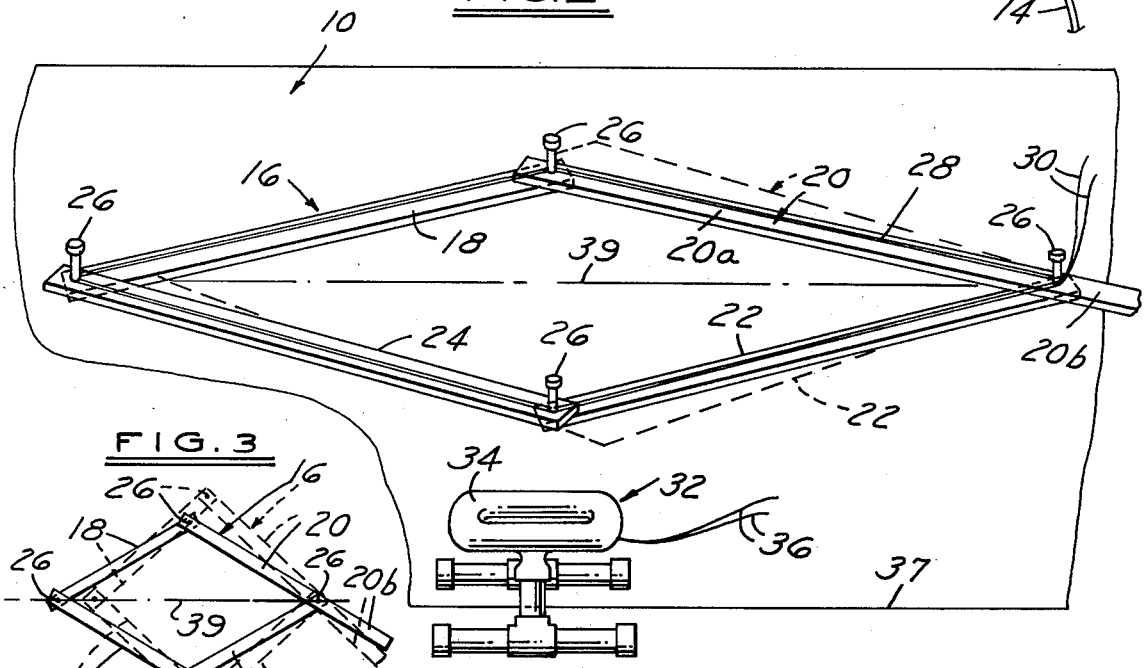
FIG. 2 is a perspective view illustrating the step of adjusting the contour of the test loop in accordance with the invention.

FIG. 2 illustrates a frame assembly 16 which comprises four linear frame members or arms 18,20,22 and 24 pivotally coupled endwise to each other by the pins 26 to form a closed quadrangle. The frame members are preferably constructed of non-conductive and non-magnetic material, such as wood. Frame members 18,22 and 24 are of identical length. Frame member 20 includes a first portion 20*a* identical and parallel to member 24, and a second portion 20*b* extending linearly from portion 20*a* beyond hinge pin 26 and the corresponding end of frame member 22 for a purpose to be described hereinafter. Thus, frame 16 forms, in effect, an adjustable equilateral parallelogram.

A test coil 28 comprising a preselected number of loops or turns of electrical wire is coiled around hinge pins 26 and stapled or otherwise attached to the underlying frame members 18–24. For reasons which will become evident as the discussion unfolds, the number of turns in test loop 28 must be equal to the number of turns required in the sensor loop ultimately installed. In a presently preferred embodiment wherein each "loop" is substantially an equilateral parallelogram 72 inches on a side, seven turns of wire in coil 28 is satisfactory. These parameters were empirically selected based upon general characteristics of a given highway system. Conductors illustrated at 30 extend from test loop 28 for connection to appropriate excitation and sensor electronics as previously described. A separate magnetic field sensor coil 32 is illustrated in FIG. 2 and may comprise any desired number of turns of electrical wire disposed within a non-conductive and non-magnetic annulus 34 carried in horizontal plane having suitable conductors 36 extending therefrom for connection to sensor electronics appropriate for the purpose to be described. ("Magnetic" and "electromagnetic" are used synonymously herein.)

Figure 3:
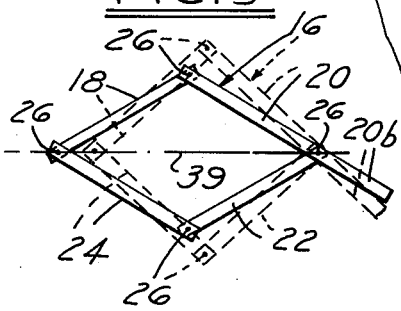
FIG. 3 is a plan view illustrating the technique of test loop contour adjustment.

In accordance with the preferred method of the invention, sensor 32 is first located at a reference position with respect to a selected highway lane which preferably comprises a lateral lane edge 37 in FIG. 2. Frame assembly 16 including test loop 26 is then located approximately centrally of the selected highway lane laterally adjacent sensor 32 as illustrated in FIG. 2, with frame element portions 20*a*,20*b* being at opposite acute angles to the lane centerline 39 (FIGS. 2 and 3) and the intermediate pin 26 being positioned thereover. Test loop 28 is then energized by a steady electrical signal, i.e. either an ac or dc signal of preselected magnitude, and the lateral dimension of the frame assembly is adjusted with respect to sensor 32. Such lateral adjustment is to be symmetrical about centerline 39 and is best illustrated in FIG. 3. This adjustment alters the surrounding magnetic field generated by the loop and is continued while maintaining the steady electrical signal within the test loop until a magnetic field of preselected magnitude is detected by sensor 32.

The magnitude of the magnetic field to be detected by sensor 32 is determined in accordance with another important feature of the invention by placing test loop 28 and frame 20 approximately centrally of any selected highway lane and then driving an intermediate size automotive vehicle back and forth along the lane edge past the loop. The loop is connected to appropriate excitation and sensor electronics, and is laterally adjusted symmetrically with the lane centerline as previously described between successive vehicle passes until the loop effectively detects proximity of the vehicle when the vehicle is within or substantially within the traffic lane, but does not detect proximity of the vehicle when the vehicle is substantially within the adjacent lane. Stated differently, frame 20 with test loop 28 mounted thereon is adjusted until a vehicle slightly more than half within the associated lane is detected, while a vehicle slightly less than half within the lane and more than half within the adjacent lane is not detected. In this connection, another important feature of the test and final loop will be appreciated. That is, positioning and adjusting with the lane centerline as a diagonal of the test loop places sharp loop corners at the side edges. The field surrounding the side corners thereby possesses a rather sharp cut-off and is rendered very sensitive to loop contour.

After the test loop has been adjusted to detect passage of the vehicle as previously described, preassembled sensor 32 is located at the lane edge adjacent the test loop as illustrated in FIG. 2, and the output of sensor 32 induced by the magnetic field surrounding test loop 28 is measured using detector electronics of given sensitivity. The value of such output is noted and the magnetic field which generates such output is then considered the preselected magnetic field for adjustment of the test loop at other locations. The measured field strength at the lane edge by a particular sensor 32 thereafter substitutes and eliminates the need for the vehicle passage operation at each location, provided that detector sensitivity remains constant. Stated differently, the sensed strength or magntiude detected by sensor 32 for distinguishing between vehicles in adjacent lanes will remain constant, even though the inductance characteristics of the highway concrete changes for each location. Moreover, it will be appreciated that the absolute value of the magnetic field generated by the test loop 28 need not be measured per se since it is only necessary that the side or edge cut-off of the magnetic field be the same at each location.

Figure 7:
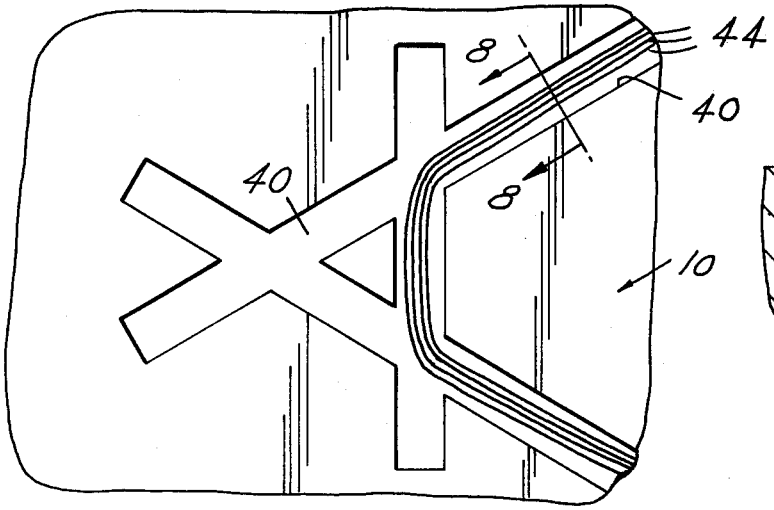
FIG. 7 is a fragmentary enlarged plan view of a portion of FIG. 6.
Figure 8:
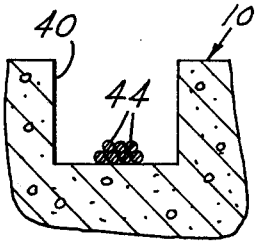
FIG. 8 is a sectional view taken along the line 8—8 in FIG. 7.
Figure 4:
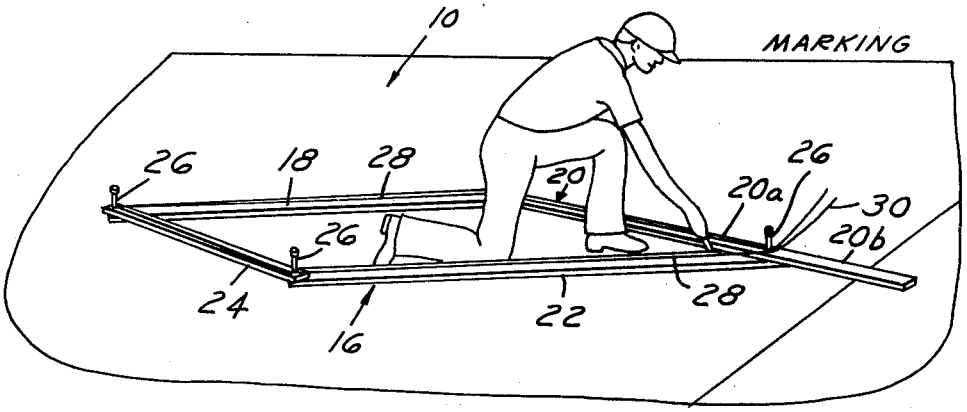
FIGS. 4, 5 and 6 are perspective views illustrating additional sequential steps in accordance with the method of the invention.
Figure 5:
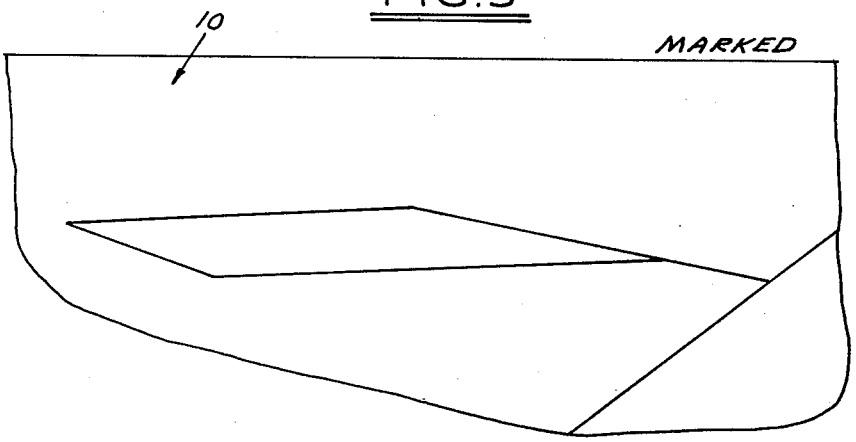
Figure 6:
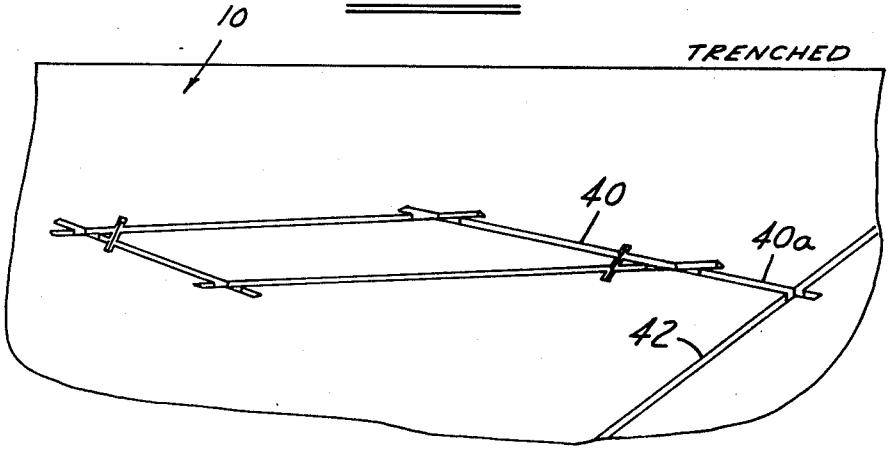

Returning to the preferred method of loop installation, after loop 28 has been adjusted to obtain the preselected output from sensor 32, the adjusted contour and location of the test loop and support frame is marked on the highway (FIGS. 4 and 5), and a trench or channel is cut along the marked position and location (FIG. 6). Such channel may have a depth of one to two inches, for example, above the reinforcing rods in the concrete. The extending portion **20*b* of frame member 20 (FIGS. 2 and 3) when marked and cut results in an extending channel 40*a* (FIG. 6) which communicates with a lateral channel 42 extending across the highway (see FIG. 1). A permanent sensor loop 44 is then wound or placed into channel 40 with twisted loop conductors extending therefrom in channel 40*a* for use in forming the multiple conductor cable 14 (FIG. 1) which is laid in laterally extending channel 42. Preferably, each corner of loop channel 40 on the lane centerline is cut in an A-configuration best illustrated in FIG. 7**. The trench is then filled with an appropriate sealing agent such as epoxy cement, and the sensors are ready for operation.

Advantages of the present invention in reliably detecting highway traffic will be self-evident from the foregoing description. However, the invention also possesses more subtle advantages. For example, it will be appreciated that the test loop configuration illustrated in FIGS. 2 and 3 comprises four straight lines which readily accommodate cutting of trench 40 using a suitable concrete saw. Moreover, the perimetric length of the test loop and frame is constant, although the various frame elements may be adjustably angled with respect to each other. Therefore, both the overall length of the saw cuts and also the overall length of the permanent coil remains constant, which will permit a contractor accurately to bid the installation costs.

As one modification to the preferred embodiment and technique according to the invention, a second sensor may be located in the vertical plane adjacent coil 32 and connected in series therewith so as to give a true reading of magnetic field strength at the lane edge.

The invention claimed is:

1. A method of installing magnetic sensor loops in a multiple lane highway comprising the steps of (a) placing magnetic field sensor means at one lateral edge of a first highway traffic lane, (b) locating a test loop having an adjustable contour in said lane laterally adjacent said sensor means, (c) varying the contour of said test loop while maintaining a steady electrical signal therein until a magnetic field of preselected magnitude is sensed at said sensor means, and then (d) permanently installing a magnetic sensor loop in said lane at the location and adjusted contour of said test loop.

2. The method set forth in claim 1 wherein said test loop is adapted to rest upon the surface of said lane, and wherein said step (c) comprises the step of adjusting said loop contour in the plane of the highway surface.

3. The method set forth in claim 1 comprising the further step of installing a said sensor loop in a second traffic lane laterally continuous with said first lane by:

(e) locating a said test loop in said second lane laterally adjacent said sensor means while maintaining said sensor means at the said lane edge between said first and second lanes, (f) varying the contour of said test loop while maintaining the same said steady electrical signal therein until a magnetic field of the same said preselected magnitude is sensed by said sensor means, and then (g) permanently installing magnetic sensor loop in said second lane at the location and adjusted contour of said test loop.

4. The method set forth in claim 3 wherein said steps (d) and (g) comprise the steps of (h) marking the locations and contours of said test loops in said first and second lanes, (i) cutting loop channels in said first and second lanes at said locations and adjusted contours, (j) placing a permanent sensor loop into each of said channels, and then (k) filling each of said channels with a sealing agent.

5. The method set forth in claim 4 wherein said permanent sensor loop and said test loop have the same member of turns of electrical wire.

6. The method set forth in claim 1, 2 or 3 wherein the step of locating a test loop in a traffic lane comprises the step of (l) providing a polygonal frame assembly comprising a plurality of at least four frame members pivotally coupled to each other in a closed loop, (m) winding a test coil of a preselected number of turns of electrical wire around said frame assembly and (n) placing said frame on the surface of a said traffic lane in a position such that a dimension of said closed loop may be selectively adjusted laterally of the said lane in the plane of said surface.

7. The method set forth in claim 1 comprising the additional step of selecting said magnetic field of said preselected magnitude by (o) placing said test loop approximately in the center of a third highway lane, (p) driving a vehicle along the edge of said third lane while varying the contour of said test loop until said test loop senses presence of said vehicle when said vehicle is within said lane but does not sense said vehicle when said vehicle is outside of said lane, and then (q) placing said magnetic field sensor means at the edge of said third lane to measure the magnetic field from said test loop, the measured magnetic field thereafter being utilized as said magnetic field of preselected magnitude.

8. In a method of installing inductive sensor loops in multiple lane highways to detect vehicular traffic in the associated traffic lane while minimizing the liklihood of detecting traffic in the adjacent lanes, the improvement comprising the step of adjustably positioning that portion of the loop adjacent the lateral edge of a selected lane while energizing said loop so as to obtain a magnetic field strength at said lane edge of desired magnitude.

9. A method of installing magnetic sensor loops in a multiple lane highway comprising the steps of (a) locating on the surface of a highway lane a test loop having contour which is adjustable in the plane of said surface, said test loop being of the type which detects proximity of an automotive vehicle by a resulting variation in loop inductance, (c) varying the lateral contour of said test loop while maintaining a steady electrical signal therein until said test loop is responsive to an automotive vehicle substantially within said lane and is unresponsive to a said vehicle in the next-adjacent lane, and then (d) permanently installing a magnetic sensor loop in said lane at the location and adjusted contour of said test loop.

* * * * *